United States Patent [19]

Lauterbach et al.

[11] 4,128,296

[45] Dec. 5, 1978

[54] ECCENTRIC BORE ELECTRICAL CONNECTING DEVICE

[75] Inventors: John H. Lauterbach, Clearwater; Frederick W. Rossler, Jr., New Port Richey, both of Fla.

[73] Assignee: AMP Incorporated, Harrisburg, Pa.

[21] Appl. No.: 831,328

[22] Filed: Sep. 7, 1977

[51] Int. Cl.[2] ..... H01R 11/02

[52] U.S. Cl. ..... 339/274

[58] Field of Search ..... 339/270, 274; 24/115 G

[56] References Cited

U.S. PATENT DOCUMENTS 2,264,754 12/1941 Hixon ..... 339/274

4,029,383 6/1977 Harding et al. ..... 339/274

*Primary Examiner*—Joseph H. McGlynn

*Attorney, Agent, or Firm*—Anthony S. Volpe

[57] ABSTRACT

A two piece electrical terminal for use with stranded electrical wires such as those used in aluminum utility cables is disclosed. A device for establishing this electrical termination comprises two mutually rotatable members each having eccentric bores. Misalignment of the bores results in the establishment of intimate metal-to-metal contact between the individual strands and between the outer strands and with the die-cast body of the connector.

7 Claims, 9 Drawing Figures

56
58
2

38
6
42
46
50
52
54
62
13
32
28
36
4
12
16
8
10

ECCENTRIC BORE ELECTRICAL CONNECTING DEVICE

FIELD OF THE INVENTION

This invention relates to an eccentric bore electrical connector for use with electrical conductors. More particularly this invention relates to the use of eccentric bore members mutually rotatable to generate compressive forces and establish a solderless electrical contact with stranded wire electrical conductors, especially utility conductors. This invention specifically relates to the electrical termination of stranded aluminum conductors.

DESCRIPTION OF THE PRIOR ART

Numerous techniques for the termination of bare stranded electrical conductors are known. In the electrical utility field, conductors may be terminated by means of a crimped terminal or by means of terminals in which a threaded member is screwed-down relative to a frame to establish the electrical contact. Other termination techniques include the use of a wedge member received within a C-shaped frame upon longitudinal movement relative to the wire, or the use of a plug member wedged into a tapered hole. In establishing such electrical terminations, care must be taken to insure that the oxide layers present on the surface of bare conductors are broken or removed to establish metal-to-metal contact. Oxide removal is especially important for terminations made with aluminum conductors, since that oxide layer effectively insulates the termination unless contact is made with the underlying bare metal. Prior art terminations therefore invariably incorporate some mechanism for puncturing, scraping, longitudinally extruding the metal, transversely shearing the metal or otherwise destroying at least portions of the oxide layer. It is also generally recognized that a cold weld must be established between the terminal and portions of the underlying metal in order to establish an effective solderless termination with bare electrical conductors, such as stranded aluminum or copper wires.

Numerous mechanical means are, of course, available for imparting a compressive load on a cylindrical member such as a wire. One such method consists of the use of mutually rotatable members having at least one eccentric bore. U.S. Pat. No. 2,264,754 illustrates the cable connector comprising two outer body members, one having an eccentric counterbore together with a ring member having an eccentric bore. Rotation of the two outer body members causes the ring to move laterally relative to a cable located within initially aligned passages to impart a transverse shear on the cable. A mechanical and possibly an electrical connection would thus be established between the ring and the cable.

Another example of an eccentric bore electrical connector for use with stranded wire terminations is shown in Application Ser. No. 823,303, filed Aug. 10, 1977, now U.S. Pat. No. 4,128,295, a continuation-in-part of Application Ser. No. 683,994 filed May 6, 1976, now abandoned. This latter electrical connector comprises mutually rotatable male and female members and a ring which retains the two members in their assembled configuration resisting the action of axial forces.

SUMMARY OF THE INVENTION

This invention relates generally to the use of eccentric bores in rotary members to establish an electrical termination with a stranded electrical wire. This invention is especially, although not exclusively, intended for use with stranded aluminum cable of the type used in the utility industry. The terminal body comprises a female part and a male part having a plug received within a counterbore in the male part. Bores in both the male and female parts are offset with respect to the axis of rotation. Retaining means secure the two body parts against axial forces during termination and interacting stops limit rotary travel. The constituent parts of the terminal may be inexpensively cast from an electrically conductive material, such as aluminum.

Among the objects of this invention are the achievement of an improved electrical and mechanical termination for stranded wire. Another object is to provide a terminal which can be cheaply manufactured. The structure of this invention is suitable for an inexpensive die casting operation. A still further object of this invention is to provide a device which can be easily applied to a conductor using only a pair of conventional wrenches. In conjunction with this last-mentioned objective, means must be included to "certify" that a sound electrical connection has been made after the device has been applied to a conductor.

BRIEF DESCRIPTION OF THE INVENTION

Figures 1, 2, 3:
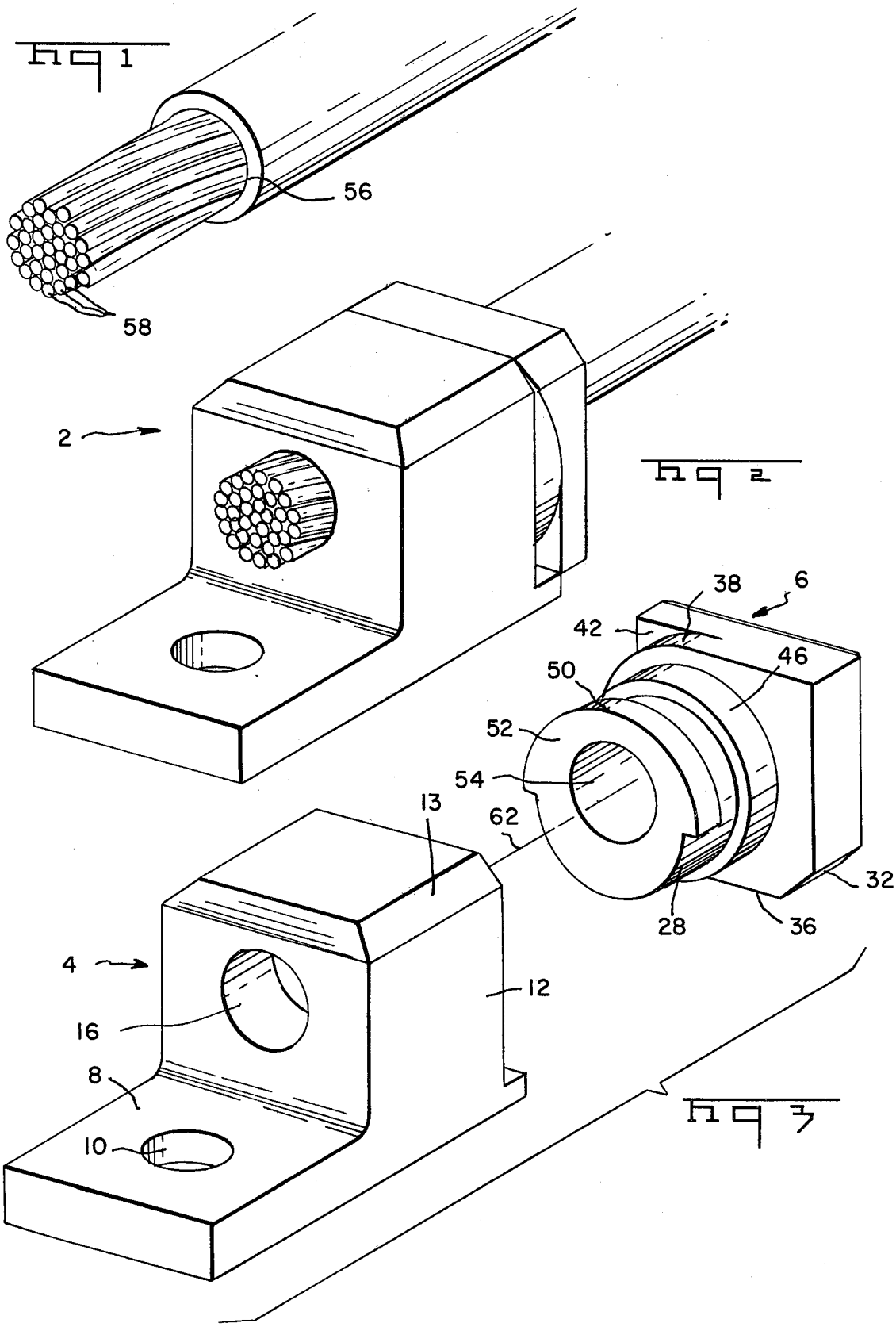
FIG. 1 is a perspective view of the end portion of a stranded wire electrical cable.
FIG. 2 is a perspective view of a connecting device in accordance with the invention installed on the end of a cable.
FIG. 3 is an exploded perspective view of the connecting device.

The preferred embodiment of this invention comprises a stranded wire connector comprising mating male and female parts. The mating parts are adapted to fit on the end of a stranded wire electrical cable 56. Rotation of male part 6 with respect to female part 4 results in relative movement of the eccentric bores in the two body parts. The strands 58 of cable 56 initially located within aligned eccentric bores are deformed by rotation of body parts 4 and 6.

The preferred embodiment of the connector assembly 2 can be cheaply manufactured using a die-cast process. A suitable aluminum alloy can be employed for fabricating a connector to be used with stranded aluminum cable. Although a connector assembly in accordance with this invention can be used with other conductive materials such as copper, this invention is especially adapted for use with stranded aluminum cable. Emphasis will therefore be placed upon the desirable aspects of this invention when used with aluminum cable, particularly of size AWG 2 or heavier.

Figure 5:
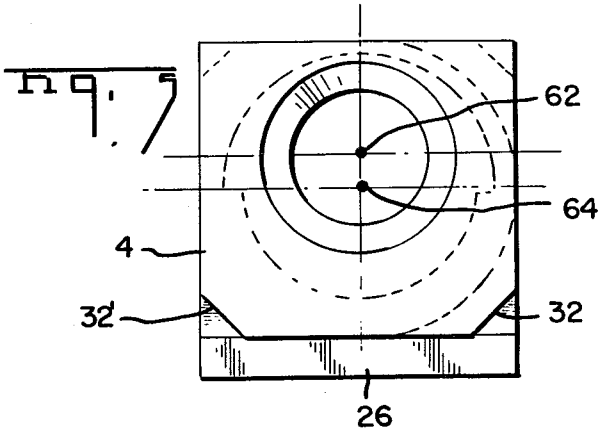
FIG. 5 is an end view of the connector assembly prior to insertion of a cable.
Figure 6:
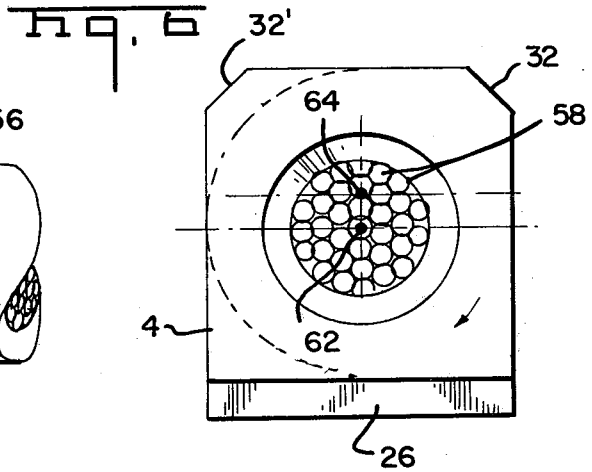
FIG. 6 is a view similar to FIG. 5 showing the position of the parts after installation of the part on the cable.
Figure 4:
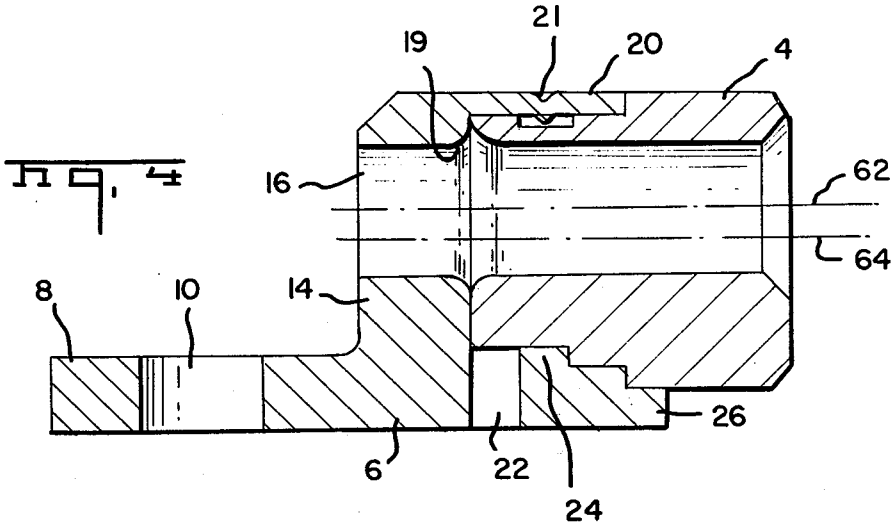
FIG. 4 is a transverse cross-sectional view of the connector showing the positions of the parts prior to installation of the device on the cable.

Female member 4 comprises integral generally prismatic body portion 12 and a laterally extending flange 8. A circular hole 10 is shown extending through flange 8. Hole 10 is suitable for receipt of a stud extending from a terminal or an electrical device. Prismatic body portion 12, as shown in FIG. 3, has a generally rectangular cross section with two chamfered edges 13 and 13'. A bore or hole 16 for receipt of a conductor of a substantially equivalent diameter extends through the rear wall 14 of body member 12. A counterbore 18 extends inwardly from the opposite face of female member 4. The axis of female bore 16 is offset from the axis of female counterbore 16. The interface between bore 16 and female counterbore 18 is defined by a radiused edge 19 extending completely around female bore 16. An annular ridge 24 extends around the interior periphery of counterbore 18. Ridge 24 as shown in FIG. 5, extends 180° along the interior periphery of counterbore 18. A transverse passage 22 extends from exterior face 23 into counterbore 18 to define annular ridge 24. Note that passage 22 and annular ridge 24 define an interior channel extending between faces 27 and 29. This passage 22 is formed during the die casting of female part 4 and is necessary in order to define ridge 24. A ledge 26 extends along the forward edge of exterior surface 23. Ledge 26 is slightly offset from the circumferential interior edge of counterbore 18. FIG. 4 shows a stake formed in face 20 of prismatic body portion 12. This stake 25 is formed after assembly of the male and female body parts and loosely retains the two parts in their initial assembled configuration.

Male part 6 consists of an integral plug member 28 and a prismatic body member 30. As with body section 12 two edges of male prismatic body member 30 have been chamfered as shown at 32 and 32'. This portion of prismatic body member 30 adjacent to exterior face 31 (the rear face as seen in FIG. 3) has a cross section equivalent to that of male body portion 14. Immediately adjacent to prismatic body member 30 is a cylindrical member extending through an arc of 180°. Interior faces 40 and 42 are formed on prismatic body member 30 adjacent to cylindrical surface 38. Note that surface 38 is tangential to both upper face 36 in the adjacent face 34 of prismatic body member 30. A second cylindrical member is next adjacent to surface 38. This second member 46 comprises a right circular cylinder and can be defined as a portion of the plug member 28. An annular recess 48 is formed adjacent to cylindrical member 46. Next adjacent is an annular ridge 50 on side of which is flushe with inner face 52 of male member 6. Note that annular ridge 50 extends through an arc of 180°. A bore 54 extends through plug member 28 and prismatic body member 30 of male member 6. In general, the diameter of bore 54 is substantially equal to the diameter of bore 16. Note that the axis of bore 54 is offset from the axis of each of the cylindrical members comprising plug member 28.

Figure 7:
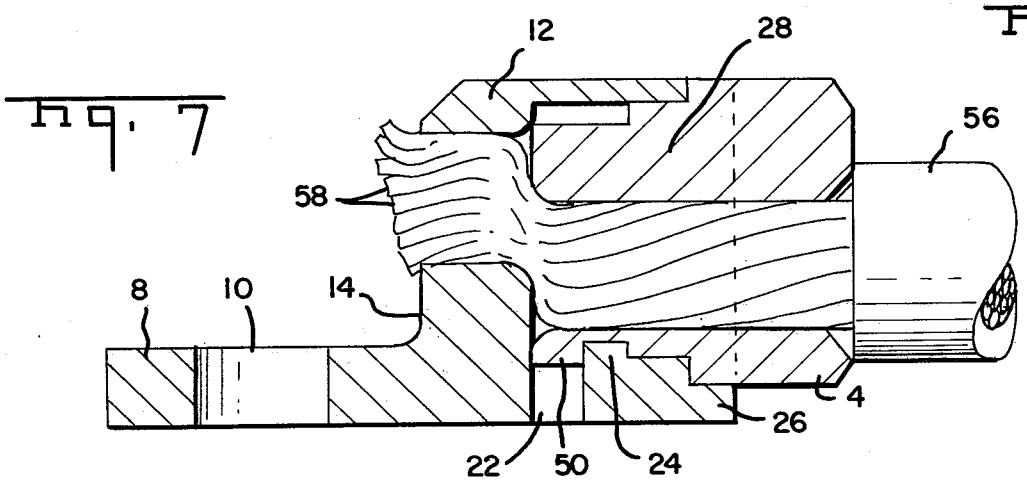
FIG. 7 is an end view similar to FIG. 4 but showing the positions of the parts after installation of the device on the cable.
Figure 8:
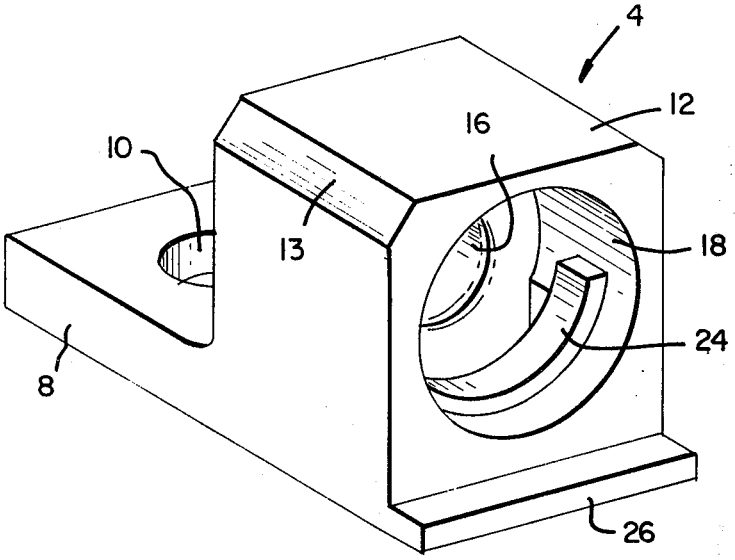
FIG. 8 is a perspective view showing the counterbore of the female connector member.
Figure 9:
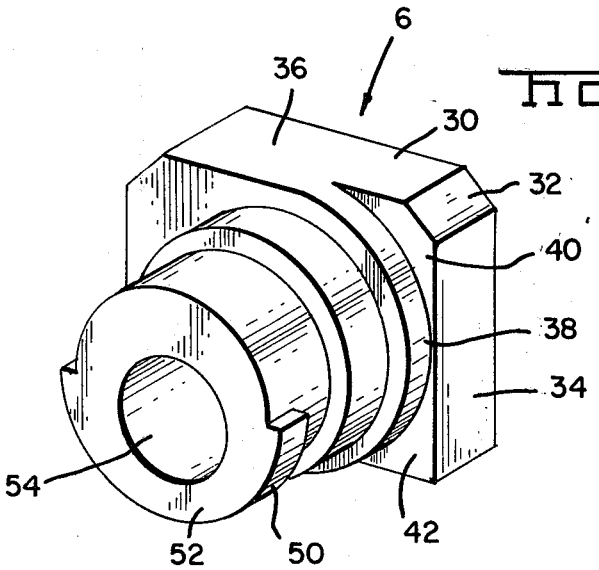
FIG. 9 is a perspective view of the male connector member illustrating the rotational surfaces.

FIGS. 4 and 7 depict the assembled configuration of connector assembly 2. Note that the plug segment of male member 6 is received in counterbore 18 of female member 6. Axis 64 in FIGS. 4 and 5 denotes the axis of plug member 46 and of counterbore 18. Axis 62 in FIGS. 4 and 5 which is offset from axis 64 denotes the axis of bores 16 and 54. Rotation of male part 6 relative to female part 4 can only occur about axis 64. Interior face 52 is immediately adjacent to the interface between female bore 16 and female counterbore 18. In the configuration of FIG. 4 female bore 16 is aligned with male bore 54. Staked section 25 extends into the recess between annular ridge 50 and section 46 of plug member 28. Note that annular ridge 50 is aligned with the channel formed by passage 52. A cable can be inserted into the aligned bores of the assembly shown in FIG. 4. The male member 6 can then be rotated relative to the female member 4 about counterbore axis 64. Ridge 54 is received within the channel formed by passage 22 to provide retention means for female and male parts 4 and 6. Axial forces tending to separate two body members during their mutual rotation are resisted by engagement of annular ridge 50 and annular ridge 24. During rotation of the male part 6 cylindrical surface 38 is immediately adjacent to ledge 26 of female part 4. Cylindrical surface 38 allows male part 6 to rotate through an arc of 180° until a flat surface of male part 6 abuts ledge 26, thereby serving as a stop means. At this point the chamfered edges on the male and female body members are in alignment indicating that termination of the wire is complete. Note in FIG. 7 that rotation through an arc of 180° defines the maximum offset of the eccentric bores in the male and female body members.

The preferred embodiment of this electrical connector is especially adapted for use with stranded aluminum cable. Use of this invention with other stranded or solid cables is, however, envisioned. Modification of the structure or addition of additional elements to adapt the invention for use in other environments will not depart from the essence of the invention as disclosed and claimed herein.

What is claimed is:

1. An electrical connector assembly, for use with an electrical conductor, consisting of a male connector member and a female connector member mutually rotatable between a first and a second position:

(a) said male connector member comprising a male body cast from an electrically conductive material and further comprising:
  (i) a plug member generated around a plug axis,
  (ii) a bore extending through said male connector member, the axis of said bore being offset from said plug axis,
  (iii) an annular ridge extending around at least a portion of the exterior of said plug member, (b) said female connector member comprising a female body cast from an electrically conductive material and further comprising:
  (i) a bore in said female body extending partially therethrough,
  (ii) plug receiving means extending from a first side of said female body and merging with said bore, said plug receiving means having a cross-section generally larger than the cross-section of said bore,
  (iii) a channel extending at least partially around said plug receiving means and extending inwardly from a second side of said female body, said channel extending transversely of said bore, (c) said assembly having said plug member in said plug receiving means with the axis of said bore through said male connector member being in alignment with the axis of said bore through said female body when said assembly is in said first position and offset therefrom when said assembly is in said second position, said annular ridge on said plug member being received within said channel during rotation of said male and female members from said first to said second position, to prevent relative axial movement, whereby, said electrical conductor may be positioned within said aligned bores when said assembly is in said first position and mechanical and electrical contact can be established with said conductor by rotation of said male and female connector members to said second position.

2. An electrical connector assembly as set forth in claim 1 further comprising stop means for preventing rotation of said assembly past said second position.

3. An electrical connector assembly as set forth in claim 1 wherein said plug receiving means comprises a counterbore, the axis of said counterbore being offset from the axis of said bore through said female body.

4. An electrical connector assembly as set forth in claim 3 wherein a shoulder extends inwardly around a portion of said counterbore, said shoulder being adjacent to said channel, said ridge on said plug member being in sliding engagement with said shoulder when said ridge extends into said channel.

5. An electrical connector assembly, for use with an electrical conductor, comprising: a female connector member and a male connector member rotatable relative to said female connector member between a first position and a second position, a first eccentric bore in said male connector member and a second eccentric bore in said female connector member, the axes of said first and second eccentric bores being aligned when said assembly is in said first position and being offset when said assembly is in said second position; stop means for preventing rotation of said assembly beyond said first and second positions, said stop means comprising an external first generally flat surface on said female connector member and opposite second and third generally flat surfaces on said male connector member, with said second surface abutting said first surface when said assembly is in said first position and with said third surface abutting said first surface when said assembly is in said second position, said second and third surface being tangential to and merging with the circumferential surface of a right circular cylindrical segment on said male connector member, and retaining means for preventing axial movement as said assembly rotates between said first and second positions, whereby said electrical conductor can be positioned within said first and second bores when said assembly is in said first position, and said conductor can be deformed by rotation of said assembly to said second position thereby establishing an electrical contact between said connector assembly and said conductor.

6. An electrical connector assembly, for use with an electrical conductor; comprising a female connector member and a male connector member rotatable relative to said female connector member between a first position and a second position, a first eccentric bore in said male connector member and a second eccentric bore in said female connector member, the axes of said first and second eccentric bores being aligned when said assembly is in said first position and being offset when said assembly is in said second position:

(a) said male connector member being integrally cast from an electrical conductive material and further comprising a first prismatic body section and a plug section;
  (i) said prismatic body section having first and second exterior oppositely facing flat surfaces and a semi-cylindrical member tangent to said first and second flat surfaces,
  (ii) said plug section generally comprising a right circular cylinder with a semi-cylindrical annular ridge extending partially therearound,
(b) said female connector being integrally cast from an electrically conductive material and further comprising:
  (i) a second prismatic body section having a cross-section generally equivalent to the cross-section of said first prismatic body section with said second eccentric bore extending at least partially through a rear wall thereof,
  (ii) a counterbore in said second prismatic body section, the axis of said counterbore being offset from the axis of said second eccentric bore, said counterbore merging with said second eccentric bore,
  (iii) a channel extending from a side wall of said second prismatic member and extending therethrough into said counterbore, the width of said channel being at least equal to the width of said annular ridge,
  (iv) an external ledge extending along one side of said second prismatic body section, said plug section being received within said counterbore with said annular ridge being received within said channel during rotation of said male connector member relative to said female connector member with said ledge abutting said first exterior flat surface in said first position and abutting said second exterior flat surface in said second position, whereby said conductor can be positioned within said aligned eccentric bores and a mechanical and electrical connection can be formed as said eccentric bores are offset by rotation.

7. An electrical connector assembly as set forth in claim 6 wherein one surface of said second prismatic member has a staked indentation extending into said counterbore on the opposite side thereof from said channel, said staked indentation being adjacent said annular ridge to retain said male and female connector members in assembled configuration.

* * * * *